United States Patent [19]

Hedren et al.

[11] 4,428,186

[45] Jan. 31, 1984

[54] CHAIN MAKING APPARATUS

[75] Inventors: Thomas Hedren, Askersund; Albert Eriksson, Laxå; Sylve Antonasson, Hallsberg; Rolf Larsson, Laxå, all of Sweden

[73] Assignee: ESAB Aktiebolag, Sweden

[21] Appl. No.: 371,252

[22] Filed: Apr. 23, 1982

[30] Foreign Application Priority Data

Apr. 28, 1981 [SE] Sweden ..... 8102673

[51] Int. Cl.[3] ..... B21L 7/00

[52] U.S. Cl. ..... 59/16; 59/18; 59/32; 59/3; 226/119

[58] Field of Search ..... 59/16, 18, 22, 3, 32, 59/35.1, 31; 226/108, 110, 113, 109, 119, 118

[56] References Cited

U.S. PATENT DOCUMENTS

| | | | |
|---|---|---|---|
| 3,355,876 | 12/1967 | Oettinger et al. | 59/22 |
| 3,701,251 | 10/1972 | Andreasson et al. | 59/16 |
| 3,945,198 | 3/1976 | Linden et al. | 59/16 |
| 4,000,606 | 1/1977 | Linden et al. | 59/22 |
| 4,141,211 | 2/1979 | Svensson et al. | 59/18 |

*Primary Examiner*—Francis S. Husar

*Assistant Examiner*—David B. Jones

*Attorney, Agent, or Firm*—Lerner, David, Littenberg, Krumholz & Mentlik

[57] ABSTRACT

Apparatus for the simultaneous manufacture of several chains by means of not less than three and not more than five operating stations (5–8) equally distributed about a circular course and serving successively to add a link to the chains and to perform the operations required to finish the link. A set of movable conveyors (11–14) equalling in number the operating stations carried by an annular supporting member (22) rotatable about the vertical axis of the course successively presents depending ends (1*a*–4*a*) of the chains to the operating stations. A set of stationary conveyors (15–18) receives the chains discharged by the movable conveyors and conveys them to points from which they can be withdrawn to localities remote from the manufacturing apparatus. The radial positions of said sets of conveyors with respect to the radial axis of the course are such as to allow each of the chains passing from a conveyor (11 to 14) of the movable set to a conveyor (15 to 18) of the stationary set to form a depending slack (1*b*–4*b*) of sufficient length to allow the required angular displacements of the movable set of conveyors.

9 Claims, 8 Drawing Figures

CHAIN MAKING APPARATUS

TECHNICAL FIELD OF THE INVENTION

The present invention relates to apparatus for the manufacture of several chains at a time by flash welding.

BACKGROUND OF THE INVENTION

The British patent specification No. 725,739 describes a machine for manufacturing chains, particularly heavy chains, by flash welding, in which the manufacture of each link takes place in several succeeding working steps at different operating stations arranged along a substantially circular course. A pillar at the centre of said circular course supports at its upper end radial arms equal in number to the operating stations, said arms being rigidly connected to form a unit in which the angles between adjacent arm are equal and equal to the angular intervals between the operating stations. The arm unit is rotatable about a vertical axis through the centre of the course. Each of the arms is provided with a conveyor for advancing the chain inwards (that is, towards the vertical axis). A drive mechanism serves to rotate the arm unit step by step in one and the same direction, the angular displacement imparted to the arm unit during each step being equal to the angular spacing of the operating stations. The angular displacements referred to serve successively to present the ends of the chains hanging down from the receiving ends of the conveyors to the operating stations along the course. In a first operating station, a piece of bar stock is heated and bent into a C-shaped lug hooked on to the last link of the piece of chain hanging down from the receiving end of the conveyor; in the next operating station, the flash welding operation is carried out; in the next operating station, a trimming operation is carried out to remove welding burrs and welding spray; and in the last operating station, a stud is added to the link. During the next angular displacement, the chain is advanced by the conveyor a distance equal to the pitch of the chain, in order to place the finished link at the proper height for receiving another C-shaped lug in the first operating station. The chains leaving the discharge ends of the conveyors are received by an open bin which is divided into four compartments and arranged to share the rotary motion of the arm unit about the vertical axis. The necessarily limited capacity of the bin renders the apparatus described unsuitable for the manufacture of long continuous lengths of heavy chain, for instance anchoring chains of the size and length required for floating oil-boring platforms.

A chain making apparatus not subject to the above limitation is proposed in the U.S. Pat. No. 3,701,251. In the apparatus described therein, a radial arm provided with a conveyor for advancing the chain inwards is rotatably supported by a tubular pillar at the centre of the circular course around which the operating stations are distributed. The discharge end of the conveyor is located above the upper end of the hollow pillar. The chain moves through the vertical passage provided by the tubular pillar into a chamber arranged below the shop floor and connected to a horizontal channel allowing the successive withdrawal of the chain towards a delivery point, for instance a lighter. This arrangement requires a mode of operation of the arm which is different from the one described in the British patent specification No. 725,739. Let it be assumed that there are N operating stations evenly distributed along the course. The successive angular displacements required to move the arm from the first to the last of N successive stations are carried out in one and the same direction, resulting in a total angular displacement of $(N-1)\cdot 360/N$ degrees, while the angular displacement required to restore the arm to the first of the N successive operating stations is carried out by rotating the arm by an angle of $(N-1)\cdot 360/N$ degrees in the opposite direction. In the example described in the U.S. Pat. No. 3,701,251, there are four operating stations; the arm is moved from the first to the last of the four stations by three counterclockwise rotation steps of a quarter-turn each, and returned to the first station by a clockwise rotation step of three-quarters of a turn.

The U.S. Pat. No. 3,701,251 also proposes to supply the apparatus with at least one additional arm supported by individual bearing means on said tubular pillar, in order to allow the simultaneous manufacture of at least two chains. This arrangement has, however, not proved successful, as the periodical twisting action to which the chains hanging down into the tubular pillar and the adjoining chamber are subjected is apt to entangle them with each other, whereby the required orderly advancement of the chains is rendered impossible.

DISCLOSURE OF THE INVENTION

The invention has for its main purpose to provide apparatus allowing the simultaneous manufacture of several chains of any desired length, in which the danger of twisting or mutual entanglement of the chains discharged from the apparatus is effectively precluded.

The apparatus according to the invention comprises means for successively presenting end portions of lengths of chain previously formed to each of not less than three and not more than five operating stations for performing a sequence of operations including bending a piece of bar stock into a C-shaped lug engaging the lowest link of said depending portion, closing said C-shaped lug to form a link, and flash welding and trimming the joint of said link, said operating stations being disposed at substantially equal angular intervals around a circular course, said means comprising

- a number of conveyors equal to the number of said operating stations, and
- means for supporting said conveyors for rotary displacement about a vertical axis through the centre of said circular course,
- the conveyors being arranged simultaneously to present the depending chain portions to the respective operating stations and having each a receiving end for supporting the depending chain portion and a discharge end the distance of which to said vertical axis is less than the one of the receiving end.

According to a characterizing feature of the invention, the apparatus furthermore comprises

- a second set of conveyors the number of which is equal to the number of said first-mentioned conveyors, and,
- stationary means for supporting said second set of conveyors in positions in which the distance of the receiving end of each of the conveyors from said vertical axis is smaller than the distances of the discharge ends of said first conveyors from said vertical axis; the discharge end of each of said second conveyors being located at the upper end of a chain withdrawal path or space outside the radial limits of the annular space required for the angular displacements of said first conveyors and the chain portions supported by them.

The rotary displacements of the conveyors of the first set are to be carried out in the way above explained with reference to the U.S. Pat. No. 3,701,251. That is, the rotation cycle of each of the conveyors of said first set comprises N−1 angular displacements in one direction, N being the number of operating stations, each of the displacements amounting to 360/N degrees, followed by a displacement of (N−1)·360/N degrees in the opposite direction. The conveyors of the second set are to be operated in such a way as to make the part of the chain bridging the gap between the discharge end of a conveyor of the first set and the receiving end of the corresponding conveyor of the second set form a slack, or depending loop, of sufficient length to allow the periodic angular displacements of the conveyor of the first set with respect to the stationary conveyor of the second set.

Other features and advantages of the invention will appear from the following description and from the accompanying drawings representing somewhat schematically two embodiments of the invention.

DESCRIPTION OF PREFERRED EMBODIMENTS

Figure 1:
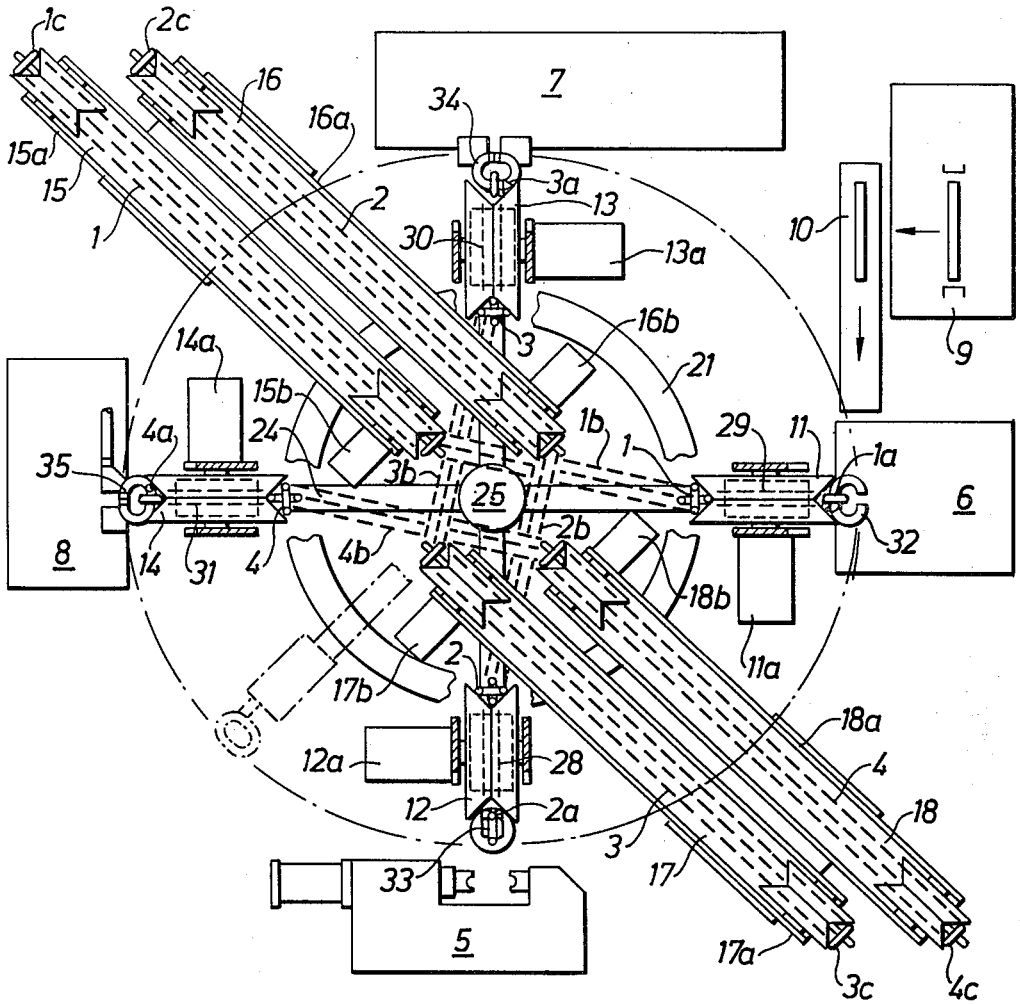
FIGS. 1 to 4 are views from above of a first embodiment of the invention represented in four successive stages of operation.

The apparatus schematically represented in FIGS. 1 to 5 comprises four operating stations 5, 6, 7 and 8 arranged at intervals of 90° about a circular course. The station 5 comprises a stud press, the station 6 a bending machine, the station 7 a flash welder, and the station 8 a weld trimmer. In addition, the apparatus comprises a bar stock heater 9 and a roller conveyor 10 for transporting the heated bar to the bending machine. The units 5 to 10 are represented schematically only and need not be described in detail, all of them being well known in the chain making art. The apparatus is arranged to manufacture four chains 1, 2, 3, 4 simultaneously. Each of the chains 1, 2, 3, 4 is supported and advanced by a first conveyor 11, 12, 13, 14, respectively, and a second conveyor 15, 16, 17, 18, respectively. A frame supporting all of said conveyors comprises two pillars 19, 20, two pairs of channel beams 15*a*, 16*a* and 17*a*, 18*a* attached to the pillars 19, 20, respectively, and an annular member 21 joining the pairs of channel beams 15*a*, 16*a* and 17*a*, 18*a*. A second annular member 22 is rotatably supported by the annular member 21. Said first conveyors 11, 12, 13, 14 each comprise a single chain wheel journalled in one of four arms 23 attached to the rotatable annular member 22, and a driving unit 11*a*, 12*a*, 13*a*, 14*a* for the chain wheel. The stationary conveyors 15, 16, 17, 18 each comprise two chain wheels journalled at either end of the channel-shaped conveyor frame 15*a*, 16*a*, 17*a*, 18*a*, and a driving unit 15*b*, 16*b*, 17*b*, 18*b* acting on at least one of the chain wheels of the conveyor. The conveyors 15 to 18 are arranged to advance the chains outwards from the central zone of the apparatus. The receiving ends of the conveyors 15 to 18 are located farther inwards (that is, nearer the vertical axis of the apparatus) than the discharge ends of the chain wheels 11 to 14 (that is, the points at which the chain links leave said chain wheels) in order to provide a gap allowing the portion of the chain extending between the discharge end of the first conveyor and the receiving end of the second conveyor to form a slack, or hanging loop 1*b*, 2*b*, 3*b*, 4*b* at any of the angular positions into which the set of chain wheels 11 to 14 are moved during the operation cycle of the apparatus.

The apparatus also includes a set of manipulators 28, 29, 30, 31 serving to move the link which is being manufactured from one operating station to the next operating station and to present it in the proper position to the link-engaging members of the operating station. Each of said manipulators is attached to one arm of a turnstile device comprising four radial arms 24 extending radially from a common hub 25 (FIG. 5) provided with a reversible drive for effecting the angular displacement of the arm system. More particularly, the position of the manipulator 28 alternates between the operating stations 5 and 6, the position of the manipulator 29 between the operating stations 6 and 7, the position of the manipulator 30 between the operating stations 7 and 8, and the position of the manipulator 31 between the operating stations 8 and 5. All of the manipulators are provided with jaws for gripping the link and with means for operating said jaws. The manipulator 31 is preferably provided with means for rotating the link 33 held therein by an angle of 90° from a horizontal to a vertical position, said rotation being carried out during the displacement of the manipulator from the station 8 to the station 5.

Figure 5:
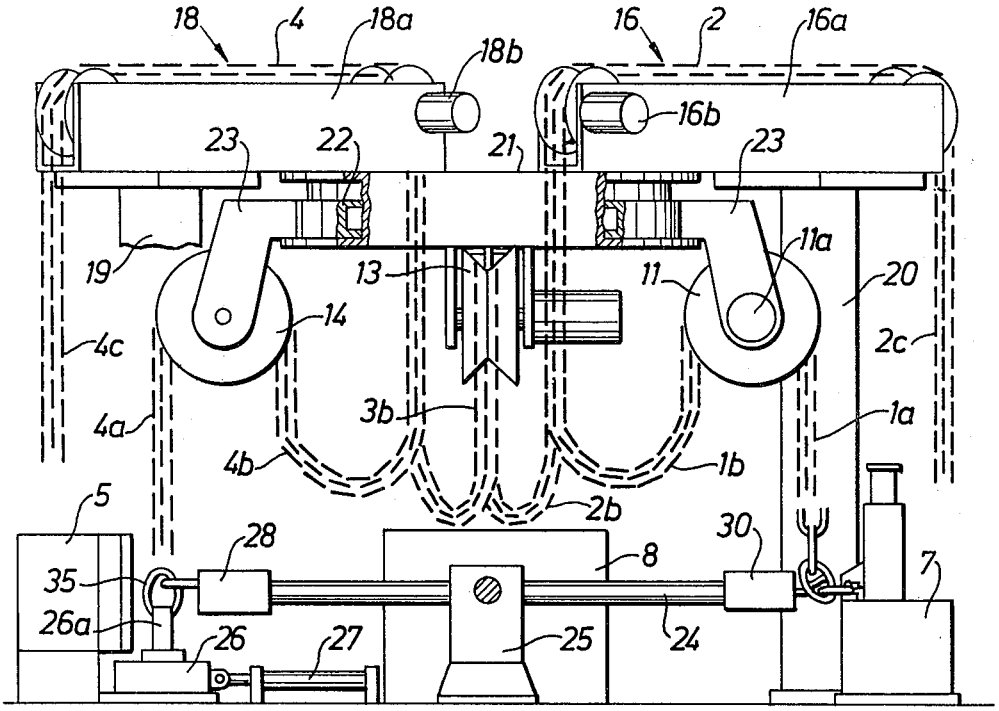
FIG. 5 is a sectional view taken along the line V—V of FIG. 2.

The embodiment shown also comprises a manipulator 26 which is associated with the stud press 5 and movable between an inner and an outer position by means of a work cylinder 27. The link 35 (FIG. 5) conveyed to the stud press station by the manipulator 31 is gripped by the jaws 26*a* of the manipulator 26, which is then displaced towards its outer position. During or prior to said displacement, the jaws 26*a* are rotated 90° about a vertical axis in order to put the link into the proper position for the stud pressing operation. When the stud welding operation is completed, the manipulator 26 removes the link from the stud press, rotates the link 90° and inserts it between the jaws of the manipulator 28, as shown in FIG. 5. The manipulator 28 removes the link to the operating station 6, in which a heated piece of bar stock is inserted into the link 35 and bent into C-shape, aternatively, the piece of bar stock may be bent into C-shape before being hooked on to the existing link.

As a rule, the bending of the bar heated in the heater 9 is effected in such a way that the plane of the C-shaped lug 32–35 will be horizontal, as shown in FIGS. 1 to 4. The horizontal position is maintained during the operations performed in the welding station 7 and the trimming station 8. The manipulators 29, 30 oscillating between said stations perform at each of said stations a horizontal reciprocatory motion to deliver the link to the link engaging members of the station and to pull the link back again. If required, the manipulators may be provided with means for vertical adjustment of the position of the link, in order to adapt the link to the position of the link clamping members of the operating station.

During the passage from the trimming machine of station 8 to the stud press of station 5, the link is rotated into a vertical position, preferably about the short main axis of the link. At the same time, the portion 1*a*, 2*a*, 3*a*, 4*a* of the chain which depends from the chain wheel 11, 12, 13, 14 is advanced the distance required to make the link rotated into a vertical position hang down from the adjoining link.

It is clear from the above that the manipulator 31 reciprocable between the stations 8 and 5 by means of the turnstile device 24, 25 must also be arranged to impart the required rotary motion to the link during its travel from the trimming machine to the stud press.

The manipulator 28 reciprocable between the station 8 and 5 (that is, between the stud press and the bending machine) fetches the finished link from the stud press and removes it in a vertical position to the bending machine. There the manipulator 28 adjusts the vertical position of the link and inserts the link between the clamping members of the bending machine, so that another heated bar may be inserted into the loop formed by the upper half of the link and the clamping members holding the lower half.

The apparatus above described operates in the following way:

In the position represented in FIG. 1, the manipulators 28 to 31 supported by the arms 24 (FIG. 5) of the turnstile device are gripping the links at the lower end of the chain portions 2*a*, 1*a*, 3*a*, 4*a* preparatory to moving them to the next station.

Phase I

The turnstile device 24, 25 as well as the chain wheels 11–14 and the annular member 22 are rotated counter-clockwise an angle of 90°. During this movement, the manipulator 31 rotates the link 35 a quarter-turn about a radial axis so as render the main axis of the link vertical. The manipulators 28–30 deliver the links 33, 32, 34 to the holding members of the machines of the operating stations 6, 7, 8. The manipulator 31 places the link in the proper position for gripping by the manipulator 26. The manipulator 26 grips the link 35 and moves it radially outwards into the stud press 5 while at the same time rotating it 90° about a vertical axis. When the links are held in the respective stations, the gripping jaws of the manipulators 28 to 31 release the links and are retracted towards the vertical axis of the turnstile device. The turnstile device is restored to its original position by being rotated clockwise 90° . The set of chain wheels 11–14 remains stationary during this rotation of the turnstile device. The manipulators 29 to 31 each grip a link as soon as the operation performed upon it in the corresponding station is finished. The machine releases the link as soon as gripped by the manipulator. At the station 5, the link is held by the manipulator 26 during the stud pressing operation. When the stud press releases the link, the manipulator 26 moves the link radially inwards and rotates it a quarter-turn into the position shown in FIG. 5, in which it is gripped by the manipulator 28. The chain wheel system 11–14 and the turnstile device 24–25 now occupy the positions represented in FIG. 2.

Phase II

The turnstile device 24–25 and the manipulators repeat the operations performed in Phase I. The chain wheel system 11–14 shares the 90° counter-clockwise rotation carried out by the turnstile device and remains in the resulting position, in which the chain wheel 12 presents a link to be welded (at the lower end of the depending portion 2*a* of the chain 2) to the welding machine of the station 7. When the links have been engaged by the gripping members of the respective operating stations, the turnstile device is restored to its first position by being rotated clockwise 90°, while the chain wheel system 11–14 remains in the position imparted to it by the 90° counter-clockwise rotation. The turnstile device 24–25 and the chain wheel system now have the positions represented in FIG. 3.

Phase III

The sequence of movements of the turnstile device 24–25 and the chain wheel system 11 to 14 is repeated. At the end of this phase, the turnstile device 24–25 and the chain wheel system have the positions represented in FIG. 4. The chain wheel 12 now presents the link welded at station 7 during the previous phase to the trimming machine of station 8.

Phase IV

When the operations performed in the stations 5–8 during the preceding phase have been carried out, the turnstile device 24–25 and the chain wheel system are submitted to a clockwise rotation through three-quarters of a turn (270°). The chain wheel 12 now presents the link trimmed at the station 8 to the station 5, in which the link is fitted with a stud in the stud press. When the links have been engaged by the gripping members of the respective stations and released by the gripping members of the manipulators 28 to 31, the turnstile system is rotated one-quarter of a turn clockwise into a position which the manipulators 28 to 31 are in readiness for gripping the respective links when the operations performed upon the links in the stations 5 to 8 have been carried out. The turnstile device 24, 25 and the chain wheel system 11 to 14 are now again in the positions represented in FIG. 1.

Figure 2:
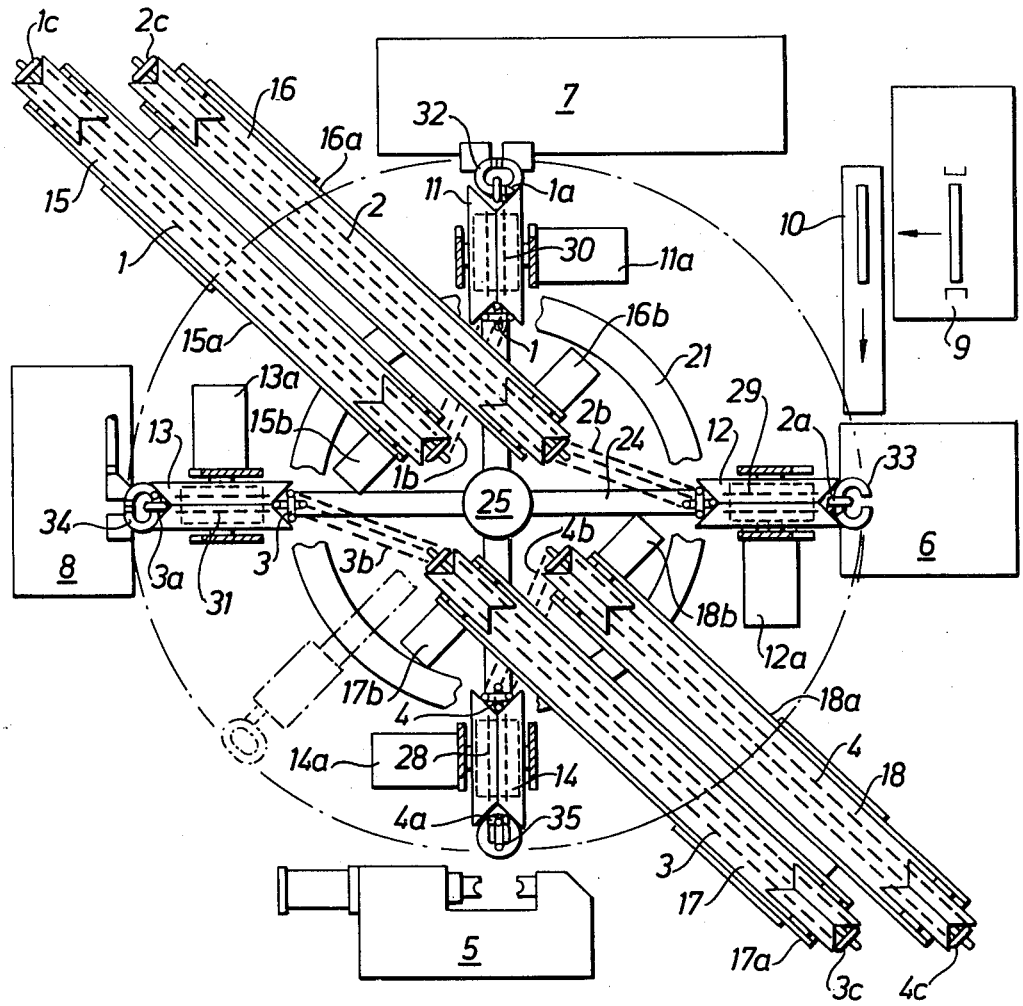
Figure 3:
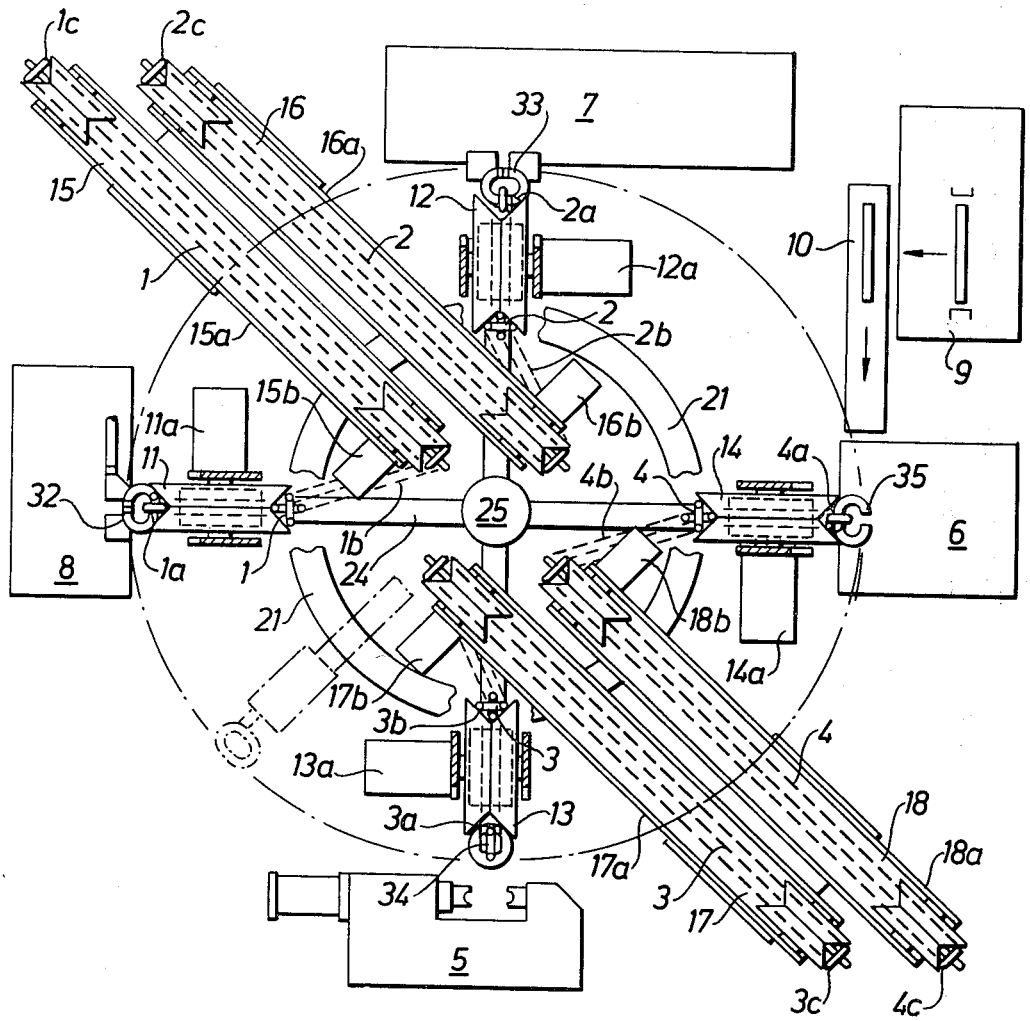
Figure 4:
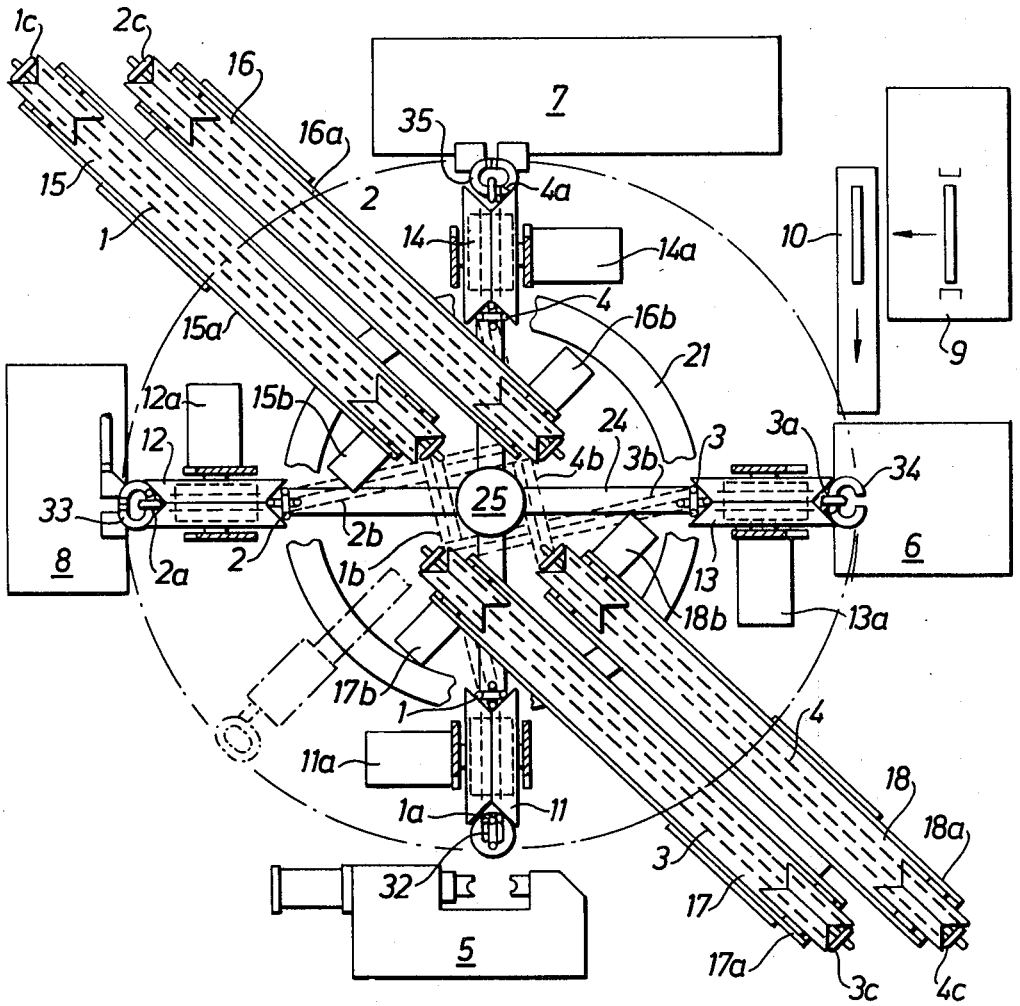

The angular movements performed by the chain wheel system and the turnstile device during the work cycle comprising the Phases I to IV are summarized in the following table:

| Phase | Initial position | Final position | Angular displacement |
|---|---|---|---|
| I | FIG. 1 | | Chain wheels and turnstile device 90° counter-clockwise. |
| | | FIG. 2 | Turnstile 90° clockwise. |
| II | FIG. 2 | | Chain wheels and turnstile device 90° counter-clockwise. |
| | | FIG. 3 | Turnstile device 90° clockwise |
| III | FIG. 3 | | Chain wheels and turnstile device 90° counter-clockwise |
| | | FIG. 4 | Turnstile device 90° clockwise |
| IV | FIG. 4 | | Chain wheels and turnstile device 270° clockwise |
| | | FIG. 1 | Turnstile device 90° clockwise. |

During the work cycle described, each of the chain wheels 11 to 14 is rotated by its driving unit 11*a* to 14*a* by the angle required to make the wheel advance the portion of the chain carried thereby a distance equal to the pitch of the chain. Also, the drive units 15b–18b of the stationary conveyors 15 to 18 are operated so as to make said conveyors advance the chain a distance equal to the pitch of the chain, in order to maintain the slack or depending loop 1b–4b hanging between the discharge side of each of the chain wheels 11–14 and the receiving end of each of the conveyors 15 to 18 at the proper length required to admit the reciprocatory angular displacements of the chain wheels 11 to 14 and to keep the chains out of engagement with each other.

The chains discharged by the conveyors 15–18 are conveyed by suitable means (not shown) to delivery points, containers etc. which may be remote from the chain making apparatus. In FIG. 5, the chains 2c, 4c discharged by the conveyors 16, 18 are represented as hanging straight down from the discharge ends of the conveyors. Various other arrangements are, of course, possible. For instance, each of the conveyors 15 to 18 may be arranged to discharge the chain into a chute in which the chain moves outwards from the chain making apparatus.

While the embodiment of the invention above described comprises four operating stations, the invention is equally applicable to apparatus comprising three or five operating stations. A minimum of three operating stations (to wit, a bending station, a welding station, and a trimming station) is required. In that case, the rotatable chain wheel system comprises three chain wheels arranged at an angle of 120° to each other, and the operation cycle comprises two successive angular displacements in one direction of the chain wheel system, amounting each to 120°, followed by an angular displacement of 240° in the opposite direction.

In apparatus comprising five operating stations, the fifth station may be an arc welding station in which the stud inserted in the preceding station is welded to the link sides. According to another possibility, the fifth station may be arranged between the trimming station and the stud press and serve to rotate the link from its horizontal position in the trimmer into the vertical position required by the stud press. With five operating stations, the rotatable chain wheel system of the apparatus according to the invention comprises five chain wheels arranged at an angle of 72° to each other, and the operation cycle accordingly comprises four successive angular displacements of the chain wheel system amounting each to 72° in one and the same direction, followed by an angular displacement of 288° in the opposite direction.

Figure 6:
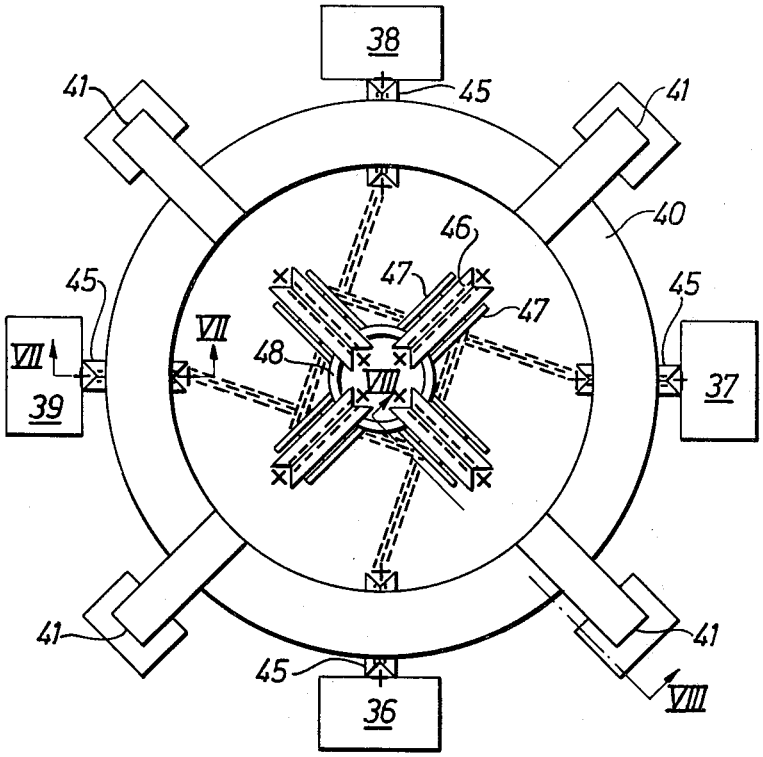
FIG. 6 is a diagrammatic view from above of a second embodiment of the invention.
Figure 7:
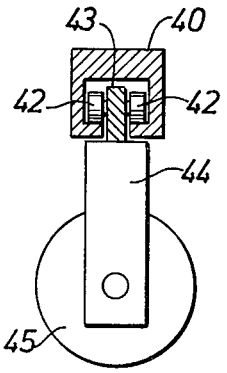
FIGS. 7 and 8 are sectional views taken along the line VII—VII and VIII—VIII of FIG. 6, respectively.
Figure 8:
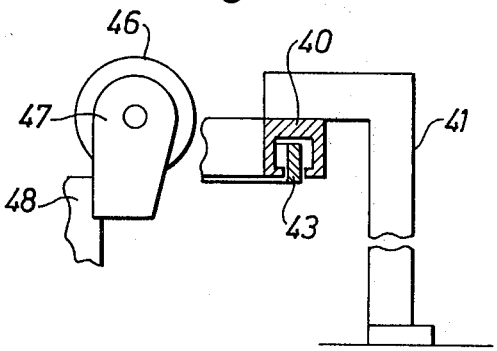

The embodiment of the invention schematically represented in FIGS. 6 to 8 comprises four operating stations 36–39 equally distributed about a circular course. A stationary annular member 40 supported by four uprights 41 is provided with tracks for a set of rollers 42 for supporting a rotary annular member 43. Four arms 44 attached to and projecting downwards from the annular member 43 each support a chain wheel 45. The chain wheels 45 correspond to the chain wheels 11 to 14 of the embodiment shown in FIGS. 1 to 5 and are provided with individual drive units not represented in the figures. A set of four stationary chain wheels 46 at right angles to each other are rotatably supported by lugs 47 attached to the upper extremity of a tubular pillar 48. The chain wheels 46 are provided with individual drive units (not represented in the figures) arranged to make the wheels 46 advance the chains inwards (towards the vertical axis of the pillar 48). The radial distance of the chain wheels 45 from the vertical axis of the pillar 48 exceeds the radial distances of the outer portions of the chain wheels 46 (that is, the portions of said wheels having the largest distance from the vertical axis) from the vertical axis, so that a gap is provided between the rotary set of wheels 45 and the stationary set of wheels 46 at all angular positions of the wheels 45. The stationary wheels 46 extend inwards beyond the edge of the tubular pillar 48 so as to discharge the chains into the interior of said tubular pillar. The advancement of the chains by the stationary chain wheels 46 is controlled in such a way as to maintain the portions of the chains extending between an outer chain wheel 45 and an inner chain wheel 46 at a length sufficient to make said portions form a slack, or hanging loop allowing the required angular motion of the outer set of wheels 45 with respect to the stationary wheels 46. The operation of the apparatus is substantially identical with the operation of the embodiment of FIGS. 1 to 5.

Suitable means not shown are provided for withdrawing the chains outwards from the open lower end of the tubular pillar, for instance in the way described in the U.S. Pat. No. 3,701,251.

What is claimed is:

1. Apparatus for the simultaneous manufacture of several chains, comprising means for successively presenting end portions of lengths of chain previously formed to each of not less than three and not more than five operating stations for performing a sequence of operations including bending a piece of bar stock into a C-shaped lug engaging the lowest link of said depending portion, closing said C-shaped lug to form a link, and flash welding and trimming the joint of said link, said operating stations being disposed at substantially equal angular intervals around a circular course, said means comprising a number of conveyors equal to the number of said operating stations, and, means for supporting said conveyors rotary displacement about a vertical axis through the centre of said circular course, the conveyors being arranged simultaneously to present the depending chain portions to the respective operating stations and having each a receiving end for supporting the depending chain portion and a discharge end the distance of which to said vertical axis is less than the one of the receiving end, the apparatus furthermore comprising a second set of conveyors the number of which is equal to the number of said first-mentioned conveyors, and, stationary means for supporting said second set of conveyors in positions in which the distance of the receiving end of each of the conveyors from said vertical axis is smaller than the distances of the discharge ends of said first conveyors from said vertical axis; the discharge end of each of said second conveyors being located at the upper end of a chain withdrawal path or space outside the radial limits of the annular space required for the angular displacements of said first conveyors and the chain portions supported by them.

2. Apparatus as claimed in claim 1 in which the receiving ends of the conveyors of said second set are arranged at substantially equal angular intervals around said vertical axis.

3. Apparatus as claimed in claim 1 in which each of said second conveyors is arranged to advance the chain outwards with respect to said vertical axis towards the upper end of a chain withdrawal path extending outside of the circular path described by said first conveyors.

4. Apparatus as claimed in claim 1 in which each of said second conveyors is arranged to advance the chain inwards towards the upper end of a central chain withdrawal path.

5. Apparatus as claimed in claim 1 in which each of the conveyors of said first set of conveyors comprises a single chain wheel and driving means therefor.

6. Apparatus as claimed in claim 1 in which the means supporting said first set of conveyors comprise a first annular member and a second, stationary annular member rotatably supporting said first annnular member.

7. Apparatus as claimed in claim 2 in which said stationary annular member is attached to frame members also supporting said second conveyors.

8. Apparatus as claimed in claim 4 in which each of said second conveyors comprises a single chain wheel and driving means therefor.

9. Apparatus as claimed in claim 1 which additionally comprises a number of link manipulating units equal to the number of operating stations means rotatable about said vertical axis supporting said link manipulating units at angular intervals equal to those of the operating stations, and, reversible driving means drivably connected to said rotatable supporting means.

* * * * *

UNITED STATES PATENT AND TRADEMARK OFFICE

CERTIFICATE OF CORRECTION

PATENT NO. : 4,428,186

DATED : January 31, 1984

INVENTOR(S) : Thomas Hedren, et al

It is certified that error appears in the above-identified patent and that said Letters Patent are hereby corrected as shown below:

On the title page in the listing for inventors "Hedren" should read -- Hedrén --.

On the title page in the listing for inventors "Antonasson" should read -- Antonsson --.

Column 8, line 41, cancel the word "for".

Column 8, line 41, after "conveyors" insert the word -- for --.

Column 8, line 54, cancel the word "for".

Signed and Sealed this

*Third* Day of *July 1984*

[SEAL]

*Attest:*

GERALD J. MOSSINGHOFF

*Attesting Officer*

*Commissioner of Patents and Trademarks*